United States Patent [19]

Nastasic et al.

[11] 4,080,916

[45] Mar. 28, 1978

[54] MARITIME PLATFORM ASSEMBLIES

[75] Inventors: Vladimir Nastasic, Leven, Scotland; Frode Johan Hansen, Kingswood, England; Donald Miller Watson, Leven, Scotland; David William Manton, Bedford, England

[73] Assignee: Redpath Dorman Long (North Sea) Limited, Bedford, England

[21] Appl. No.: 769,293

[22] Filed: Feb. 16, 1977

Related U.S. Application Data

[63] Continuation of Ser. No. 595,602, Jul. 14, 1975, abandoned.

[30] Foreign Application Priority Data

Jul. 23, 1974 United Kingdom ..... 32513/74
Nov. 15, 1974 United Kingdom ..... 4126/74

[51] Int. Cl.[2] ..... B63B 9/00

[52] U.S. Cl. ..... 114/65 R; 29/469; 52/116; 52/120; 61/88; 114/258; 114/264; 214/14

[58] Field of Search ..... 52/116, 120; 114/65 R, 114/264, 265, 258, 266, 77 R, 230; 29/469; 61/87-89, 94, 96, 98-100; 214/14

[56] References Cited

U.S. PATENT DOCUMENTS

| | | | |
|---|---|---|---|
| Re. 24,254 | 12/1956 | Dawson | 61/87 |
| 720,997 | 2/1903 | Becker | 61/98 X |
| 2,601,762 | 7/1952 | Clark | 61/96 X |
| 2,939,290 | 6/1960 | Crake | 61/87 |
| 2,946,566 | 7/1960 | Samuelson | 114/265 X |
| 3,253,417 | 5/1966 | Manning | 61/89 |
| 3,498,065 | 3/1970 | Templeton | 114/230 X |
| 3,517,516 | 6/1970 | Bea | 61/88 |
| 3,740,957 | 6/1973 | McKensie | 214/14 X |

*Primary Examiner*—Trygve M. Blix
*Assistant Examiner*—Sherman D. Basinger
*Attorney, Agent, or Firm*—Bacon & Thomas

[57] ABSTRACT

A method of fabricating a maritime assembly comprising the steps of stabilizing a foundation raft alongside a quay, moving at least a part of an erect tower structure from the quay onto the foundation raft, securing the tower structure to the foundation raft, and floating the assembly so formed away from the quayside site. Additionally a particular method for fabricating a tower structure is described, and a particular foundation raft and a method of constructing such foundation raft are outlined. The method of the invention is not limited to particular method for fabricating the tower structure, or the particular foundation raft.

5 Claims, 21 Drawing Figures

Figure 1A:
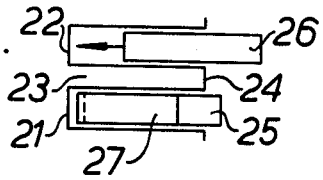

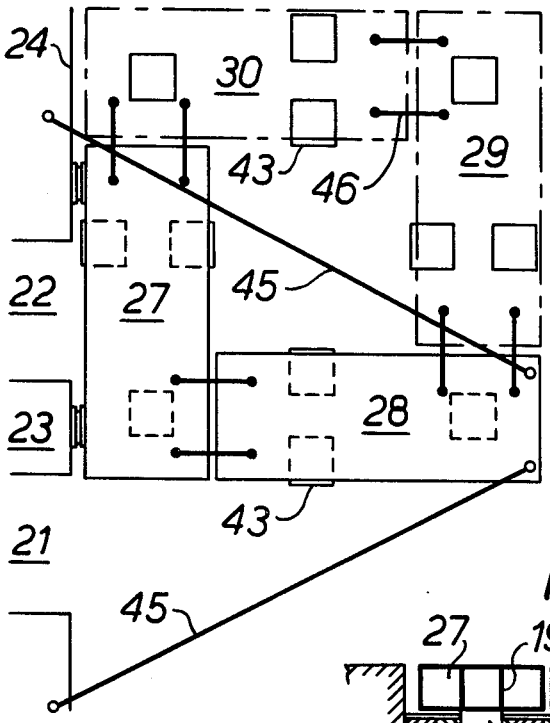
FIG. 8.
FIG. 7.
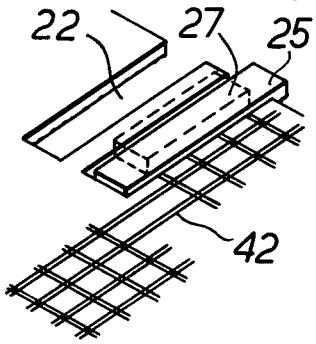
FIG. 9.
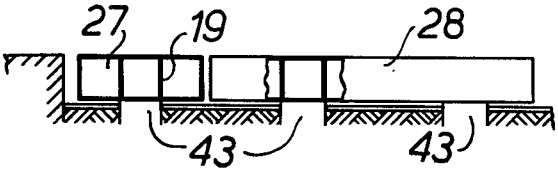
FIG. 10.
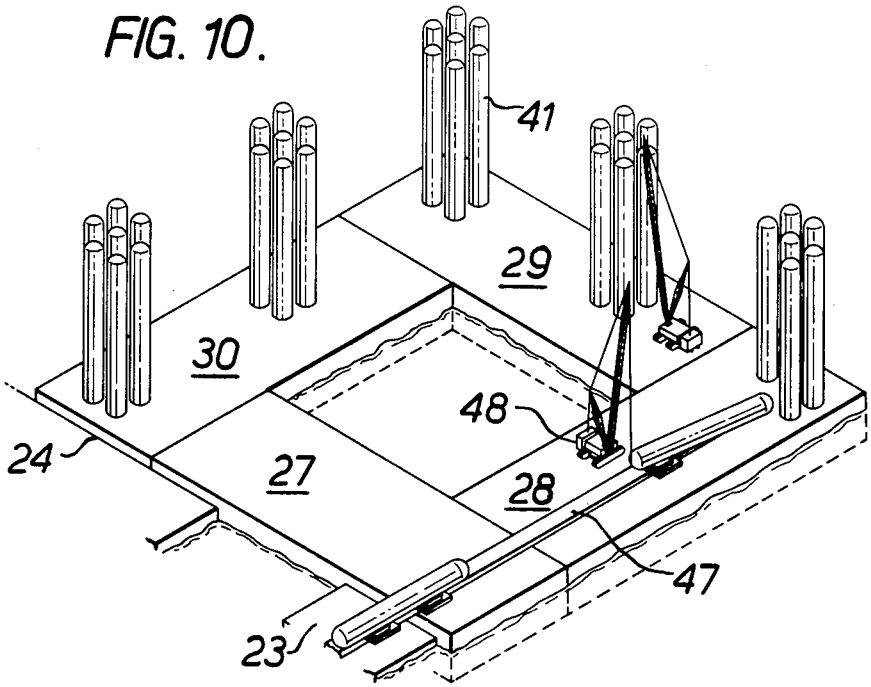

MARITIME PLATFORM ASSEMBLIES

This is a continuation, of application Ser. No. 595,602, filed July 14, 1975 and now abandoned.

The invention relates to the building of maritime assemblies for incorporation inter alia into oil production platforms. The invention is particularly but not exclusively concerned with the building of hybrid gravity platforms in which a steel tower structure extends upwardly from a foundation raft set on a sea bed.

To produce oil from deep sea locations, production platforms can be founded on the sea bed and then have oil wells drilled outwardly therefrom. The platforms should be securely located on the sub aqua terrain; and to this end it has been proposed to build concrete platforms in which concrete towers extend upwardly from massive concrete bases. Such platforms suffer from at least three major disadvantages.

Firstly since the current method of building a concrete platform is to start at the base, and to continue pouring concrete until the top is reached, it is not possible to fabricate concurrently sub assemblies for different heights above the base.

Secondly it has been found difficult to secure suitable sites for construction yards. This has been due in part to the need for sites to be located adjacent to sheltered deep water close in-shore, at localities where both adequate transport facilities and the necessary skilled personnel are readily available. Thirdly, due to their great mass, concrete platforms impose high stresses on the sea bed, which limits their use to ground conditions capable of resisting these stresses.

As an alternative to an all concrete gravity platform it has been proposed to build hybrid platforms in which a concrete (or steel) foundation raft supports a steel jacket or tower structure. This alternative enables work to proceed concurrently on the tower structure and the foundation raft, thus allowing a quicker construction program. Moreover the work can be carried out without the need for deep water close inshore, and results in a lighter structure which can be adapted to a wider range of seabed soil conditions.

However, difficulties arise in joining the two parts together. For instance it has been proposed to sink the foundation raft at its installation site, and then lower the tower structure on to it as described in British patent application No. 34682/73 which corresponds to U.S. Pat. No. 3,896,628. Another proposal has been for the tower structure to be lowered onto the foundation raft when the latter has been temporarily submerged in a sheltered deep water fiord; the foundation raft is then raised, a permanent joint effected, and the completed assembly is thereafter towed off to its intended site. Both these proposals involve accurate alignment of the parts to be joined while those parts are deep under water.

It is desirable for towage considerations to reduce the built in weight which must be floated out with the platform. As a consequence of reducing the weight the initial draft of the platforms can be reduced, so widening the choice of sites for a construction yard. In particular, existing sites could be used to construct shallow draft hybrid platforms without the need to create new sites in hitherto undeveloped areas.

The invention provides a foundation raft intended to support or supporting legs (109, 110) of a tower structure for a (e.g. hybrid) maritime assembly, comprising at least three raft sections which when joined together form a composite raft with a generally central aperture therethrough so to give direct access from the top of the tower structure to the sea bed beneath it when the assembly is founded.

More specifically the invention provides a foundation raft intended to support or supporting legs of a tower structure (40) for a (e.g. hybrid) maritime assembly, comprising four raft sections of generally rectangular planform and joined to form a composite raft with a central aperture so to give direct access from the top of the tower structure to the sea bed beneath it when the assembly is founded.

The invention also provides a method of fabricating a tower structure (e.g. for a hybrid gravity platform) comprising the steps of constructing two side frame elements on the ground with their bases occupying their respective places on the planform of the completed tower, and then raising the side frame elements to a generally vertical position by pivotal action about their respective bases, and joining adjacent edges of the side frame elements.

The invention further provides a method of fabricating a maritime assembly comprising the steps of stabilizing a foundation raft alongside a quay, moving at least a part of an erect tower structure from the quay onto the foundation raft, securing the tower structure to the foundation raft, and floating the assembly so formed away from the quayside site.

The invention includes a tower structure and maritime assembly in accordance with the methods of the invention.

Some specific embodiments of the invention will now be described by way of example with reference to the accompanying drawings in which:

FIG. 1*a* and *b* to 6*a* and *b* show in plan and section respectively successive stages in the fabrication of a foundation raft for a hybrid maritime assembly and the connection of a tower structure to that foundation raft.

Figure 4A:
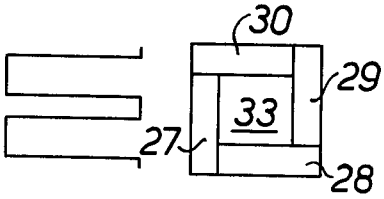

FIG. 7 is a diagrammatic perspective view showing how a raft section can be moved onto a pontoon, FIG. 8 is a plan illustrating an alternative method to that shown in FIG. 4*a* for joining sections of the foundation raft together, FIG. 9 is a cross-section on FIG. 8, FIG. 10 is a perspective view of a partially completed raft.

Figure 11:
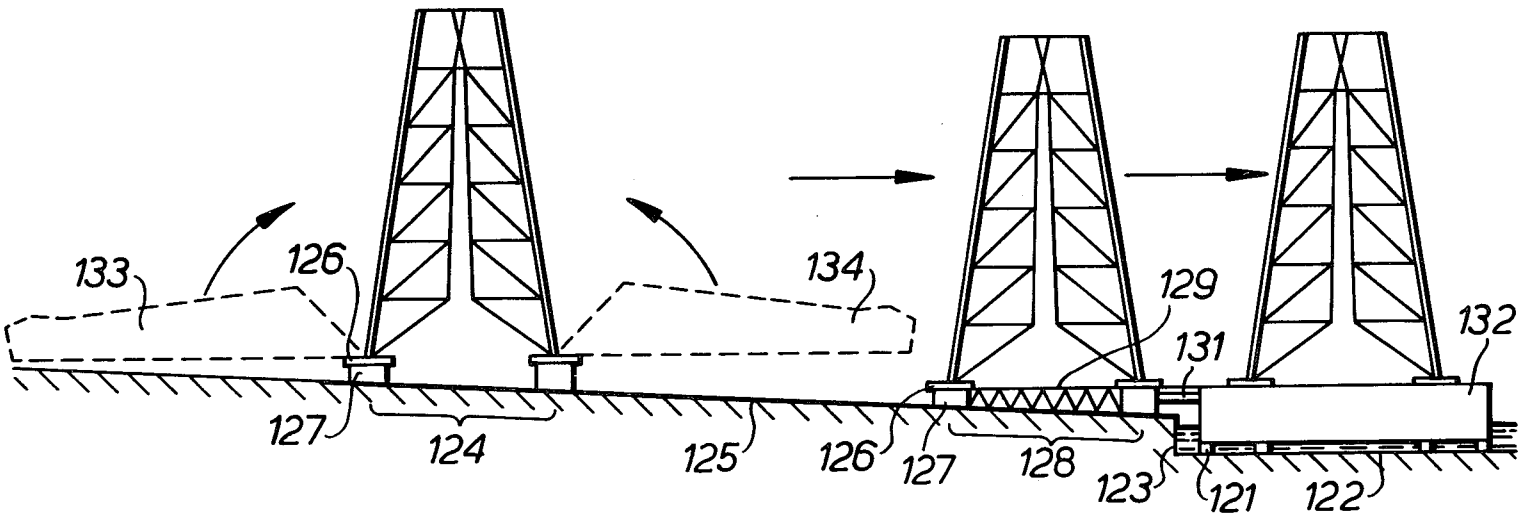
Figure 12:
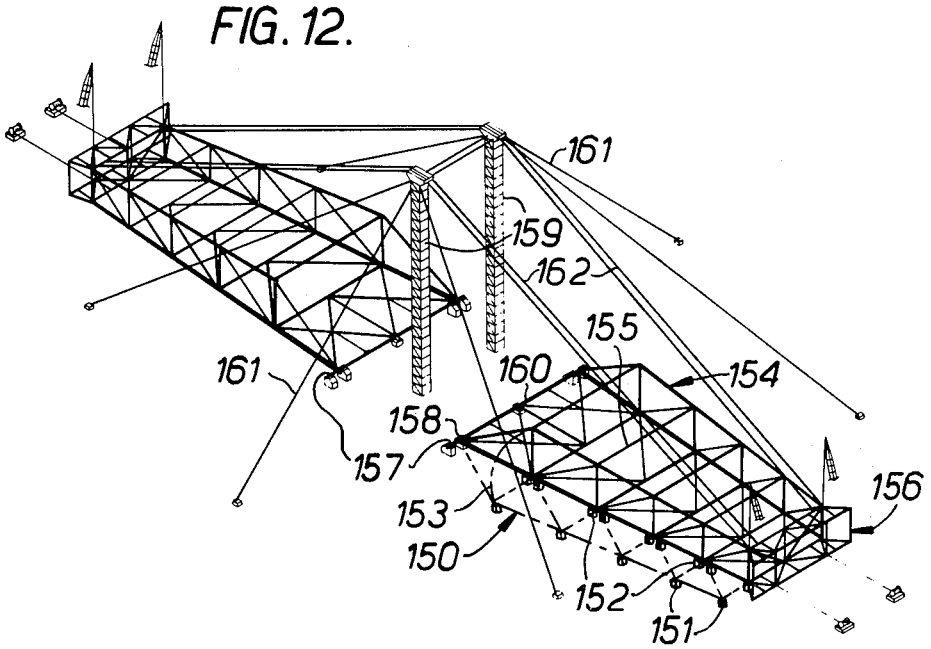
Figure 13:
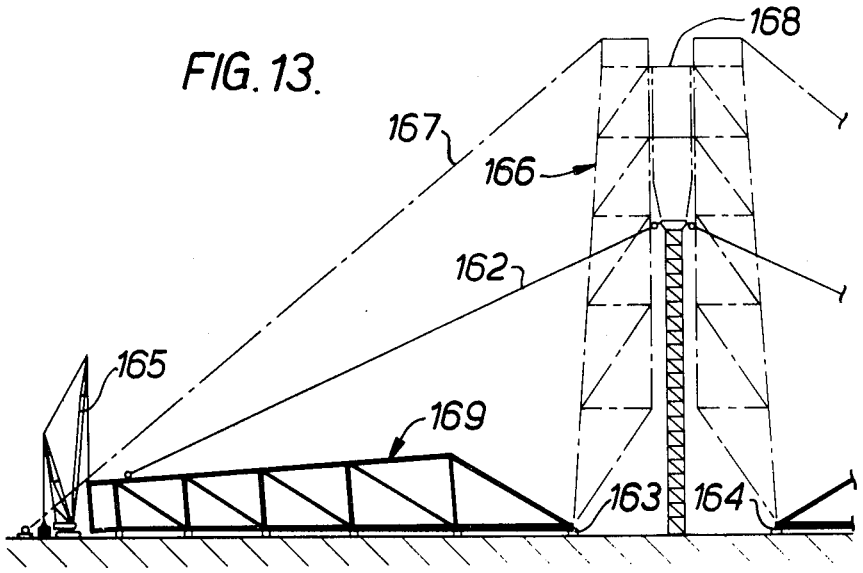
Figure 14:
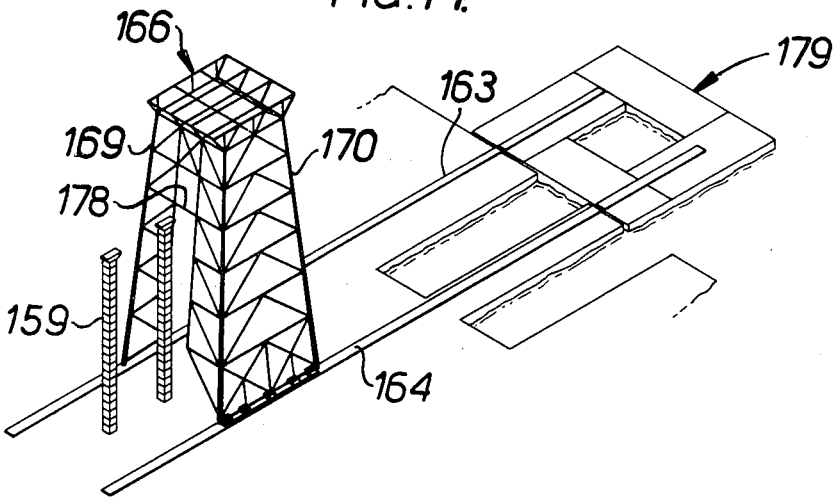
Figure 15:
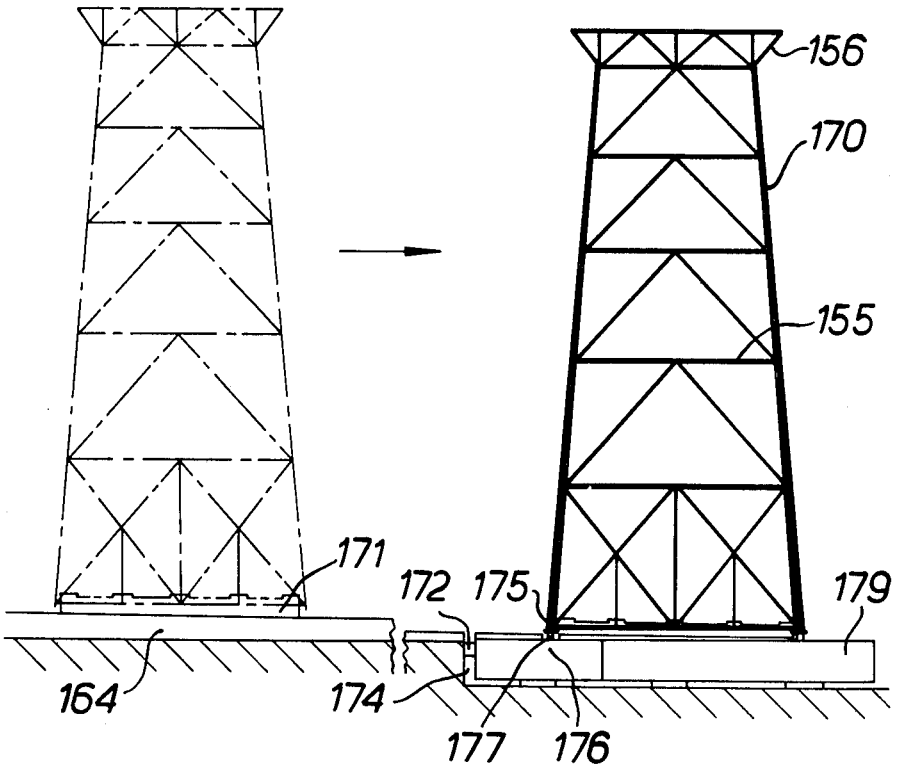

FIG. 11 is a diagrammatic side view showing a second method of fabricating a tower structure and connecting that tower structure to a foundation raft, FIG. 12 is a perspective view showing early stages in a third method of fabricating a tower structure, FIG. 13 is an end view illustrating later stages of the method begun in FIG. 12, FIG. 14 is a perspective view showing the tower structure of FIG. 13 being moved down a pair of skidways, and FIG. 15 shows that tower structure being moved onto a foundation raft.

In the description relating to FIGS. 1 to 6 all the '*a*' suffix drawing are plans, and all the '*b*' suffix drawings are longitudinal sections corresponding to those plans.

Figure 1B:
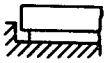

FIG. 1 shows two docks 21 and 22 separated by a finger jetty 23, bounded at its seaward end by a quay face 24. A submersible pontoon 25 has been introduced into the dock 21, and has been ballasted to sink on the dock bed; while a similar pontoon (26) is just being moved into dock 22.

A concrete foundation raft section 27 is constructed on top of the pontoon 25, or alternatively is moved onto it down tracks 42 as shown in FIG. 7.

Figure 2A:
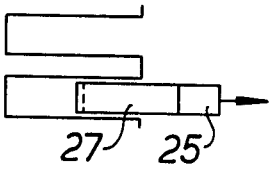
Figure 2B:
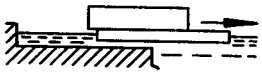
Figure 3A:
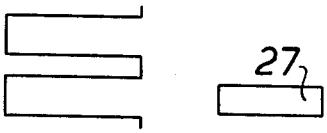
Figure 3B:
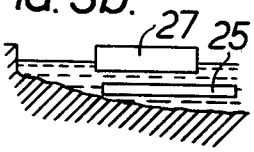

When the raft section 27 is sufficiently formed the pontoon 25 is pumped out, floated off the dock bed, and then moved out of the dock, as shown in FIG. 2. In deeper water a small distance off shore the pontoon 25 is sunk, and the raft section 27 is left floating as shown in FIG. 3. If the section 27 has not already been completed it can be moved alongside the quay 24, where further concrete can be poured. In any case the pontoon 25 is freed from its burden, so that it can be moved back into the dock 21 where the process can be repeated to produce a second raft section (28).

While the raft sections 27 and 28 are being constructed in dock 21 two further raft sections 29 and 30 can be constructed in dock 22. Clearly one dock could be used four times, or four docks could each be used to produce one raft section, but for scheduling reasons it is convenient to use each of two docks twice.

In a varient (not illustrated) the docks 21 and 22 could be transformed into dry docks by using floating gates, so that the pontoons could be dispensed with.

The raft sections 27 to 30 are of cellular concrete construction, reinforced with intermediate beams 19 to receive tower legs and to rest on ground beams or pads. The raft sections include internal column locating bolts, and pre and post stressing bars. Additionally they may be adapted to provide oil storage tanks.

Figure 4B:
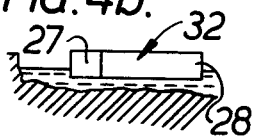

FIG 4 shows a composite foundation raft 32 formed by joining the four raft sections 27 to 30 in end to edge relationship while they are afloat, so to form a square raft with a central aperture 33. From the plan view it can be seen that one end of each section abuts and is fixed to one side of the next section. When the sections have been joined, additional concrete can be poured to complete the raft.

While the foundation raft has been described as being made of concrete it could alternatively be made of steel. The completed raft 32 is next floated to a position against a sea wall, which may conveniently be the quay face 24. To stabilize the raft sand 31 may be pumped underneath it to provide support as shown in FIG. 5*b*.

Alternatively resiliently capped reinforced concrete pads 43 are cast onto bed rock just off the quayside or sea wall as shown in plan in FIG. 8 and in section in FIG. 9. The pads provide a base upon which the combined foundation raft can be assembled and then stabilized for installation of an erect tower structure.

The raft sections are brought individually to the site, and the section 27 is stabilized alongside the seal wall 24. The section 28 is positioned in end to edge relationship therewith using cables 45, and is then drawn into its appropriate position on the pads 43. Subsequently the sections 29 and 30 (shown in chain dotted lines in FIG. 8) are similarly located and sunk onto the pads.

The raft sections may be ballasted onto the pads 43 by admitting water only to the midside compartments — thus leaving the corners of the foundation raft empty for subsequent assembly work when the tower legs are placed thereon. Floatable seals beneath the raft sections may be used to confine grouting material used in the joining procedure.

While the foundation raft is being constructed a tower structure 40 may concurrently be fabricated on an adjacent shore site.

Figure 5A:
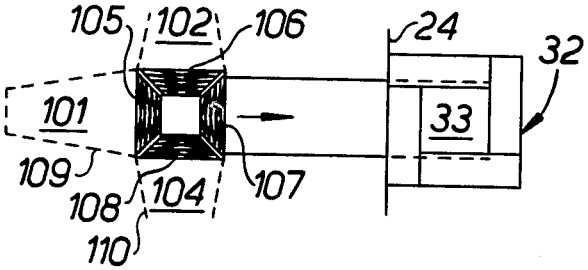
Figure 5B:
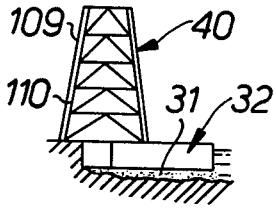

As shown in FIG. 5*a* four side frames 101 to 104 of the tower structure are laid out on the ground and welded up with their bases 105 to 108 (i.e. their tubulars which will rest on the raft) occupying the platform of the tower structure, and hinged for rotation about the axis of those tubulars. When the four side frames have been welded up at ground level they are swung upwardly by cranes and/or tackle mounted on rearing towers to form the tower structure, and adjacent edges of the side frames are welded together by means of ties. In this way each of the four corners of the tower structure is constituted by a twin leg formed by the longitudinals (e.g. 109 and 110) of adjacent side frames. At this stage cross bracing can if necessary be welded in situ to strengthen the tower structure.

Advantageously the pivot arrangements for raising the side frames would be mounted directly on a sledge units, and a suitable ground beam would be installed between the sledges supporting opposite side frames in order to prevent movement during rearing.

It will be understood that while the tower structure in FIG. 5*a* is square, with four identical side frames, the technique of fabricating side frames on the ground and then pivoting them upwardly to form a tower structure can be used to erect any generally planar components if their base lines are spaced apart and lie on the planform of the tower structure.

As shown in FIG. 5*b* the completed tower structure (or jacket) 40 is slid onto the stabilized foundation raft 32 on sledges (not shown). In order to equalise (as far as possible) the jacket leg loads during sledging the sledges are arranged centrally between each pair of corner legs (109 and 110) and support the legs on a transverse beam between them. Allowance is made in the concrete raft sections to allow the tower structure to be slid on at this stage. When the tower structure is in position it can be secured to the foundation raft, and when this has been done the assembly can be completed. Clearly advantages are gained by doing this adjacent the yard in which the tower structure was fabricated.

The addition of the tower structure adds considerable weight on top of the foundation raft, and to float the assembly off the sand positioned beneath it the raft sections can be pumped out.

Figure 6A:
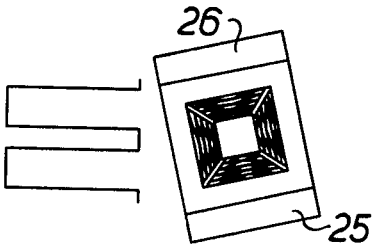
Figure 6B:
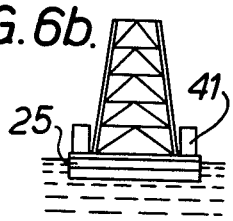

The raft is preferably designed to have sufficient buoyancy (when the raft sections 27 to 30 have been pumped out) to float the assembly off the sand 32. However if additional buoyancy is needed the pontoons 25 and 26 can be submerged on either side of the assembly, attached thereto, and floated out to sea as shown in FIG. 6.

In order to give additional stability while the assembly is being towed to its installation area, and during the subsequent sinking operation to the sea bed, steel cylinders 41 are added to the corners, and if necessary to the midpoints of the sides, of the foundation raft.

The cylinders 41 may add sufficient buoyancy to the assembly to pull the center of buoyancy above the center of gravity when they become fully submerged, and permit the foundation raft to be fully flooded, thus protecting the raft against excessive differential water pressures during the sinking operation. These cylinders may be detachable from the assembly when it is installed on its production site, for reuse on another assembly, or may remain in position on the completed production platform to form an oil storage facility. The installation of the cylinders is shown in FIG. 10, which shows a cylinder being slid onto the foundation raft along a track way 47, whereafter it is erected using a crane 48, and bolted to other such cylinders to form a cluster.

When on site, production wells can be passed through the aperture 33. The provision of an aperture in the middle of the foundation raft diminishes the danger from a well blowout. Also, in the unlikely event of sliding, the aperture will allow the production wells to deflect without shearing the down pipes, as would happen with a solid based raft.

The sliding resistance of the assembly can be improved by placing sand or gravel within the rim or shield consisting of the raft elements surrounding the aperture 33. The weight of the sand or gravel may be used to force shear keys through soft layers of sea bed strata when necessary. External anti scouring protection can be added in the form of hinged panels (or a downwardly extending skirt) on the outside of the foundation raft, and any space between the base of the foundation raft and the sea bed can be back filled with sand.

Referring now to FIG. 11, illustrating a second embodiment of the invention, a tower structure is erected on a site 124 at the head of a slipway 125 (the slope of which is greatly exagerated in the drawing — the actual slope being 1:100). In this case the tower structure is erected in two halves 133 and 134 with its rest 126 resting of sledges 127. The two halves are pivoted about their base lines perpendicular to the direction of the slipway 125; that is from the position shown in dotted lines to the positions shown in full lines on the left hand side of FIG. 11.

When the tower structure is substantially complete the sledges 127 are moved down the slipway to position 128. At this stage the space between the sledges if filled with a temporary track 129 level with corresponding tracks on the combined raft 132. As shown in FIG. 11 reinforced concrete ground beams 121 (upon which the combined foundation raft can rest) are cast onto bed rock 122 just off the quay or sea wall 123. When the raft sections have been sunk onto the ground beams, and prior to the pull out step, the joints between the raft sections can be grouted. The sledge nearest the foundation raft is kept apart from the raft by spacers 131, and the left 126 of the tower structure are pulled out to their position in the completed assembly.

A third and preferred technique for raising the tower structure is shown in FIGS. 12 and 13. In this case the two halves of the tower structure are assembled with their base tubulars lying on its planform parallel to and overlying the slipways upon which the completed tower structure will be slid onto a foundation raft; thus the tower halves initially lie perpendicular to the slipway. As shown particularly in FIG. 12 sub assemblies, such as 150 (as shown in dotted lines), are constructed very close to ground level as flat frames. The nodes of the sub assembly 150 are supported on concrete standings 151, and saddle assemblies 152 are arranged along what will become one leg of the completed tower structure. When the sub assembly 150 is complete, it is reared as illustrated by the dotted line 153 so that it lies in a vertical plane. Similarly another sub assembly 154 is constructed for rotation about the axis of another of the legs of the completed tower structure.

The space between the two sub assemblies 150 and 154 is then spanned by cross members 155 and an integral superstructure support assembly or deck 156. It will be appreciated that all this work is done close to ground level, and so is less susceptible to interference by adverse weather conditions. When the sub assemblies have been raised, the base tubular 160 is extended with stub axles 157, and is supported on rearing saddles 158.

While the tower halves are being assembled, two rearing towers 159 are erected between the two halves of the tower structure. The rearing towers are stayed by cables 161, and are connected to the super structure support assemblies 156 by rearing cables 162.

Referring now to FIG. 13 the two half tower assemblies lie flat on the ground with their bases lying along the slipways 163 and 164. When the cross members 155 have been fitted, the rearing cables 162 and high cranes 165 are used to pivot the tower halves simultaneously about the base tubulars lying on the tower planform into the position shown in chain dotted lines 166. As the tower halves pass over top dead center the rearing cables 162 become unloaded, and support cables 167 prevent the two sides of the tower structure from overturning and fouling the rearing towers.

A small amount of infill bracing 168 can now be added, and the tower structure is then able to slide down the slipways 163 and 164 over the rearing towers onto a foundation raft.

The tower structure described above can be made of small diameter tubulars, which are relatively transparent to approaching waves, and moveover require little internal stiffening.

FIGS. 14 and 15 illustrate a third and preferred technique for placing an erect tower structure on a foundation raft. In this case the tower structure 166 has been reared in two halves 169 and 170, by pivotal action on axes overlying two skidways 163 and 164.

The tower structure 166 is lowered onto sledges 171 overlying the skidways using sandjacks, and is then moved clear of the rearing towers to the position shown in chain dotted lines in FIG. 15, where intermediate frame members 178 between the two tower halves are completed.

The erect tower structure is then moved down the skidways and over a fender 172 spanning the gap 174 between the quay and the foundation raft and so onto the foundation raft 179. The skidways on the foundation raft are removable and overlie intermediate beams 19. The legs 175 of the jacket are designed to fit onto precast bolted connections 176 on the raft sections, and are lowered thereonto using further sand jacks 177. Thereafter the legs can be bolted down using tensile bolts and then grouted up.

It will be appreciated that clusters of cylinders (not shown in FIG. 14) can be disposed on the four corners of the foundation raft, and at the mid points of the three sides away from the skidways without hindering movement of the tower structure onto the foundation raft.

We claim:

1. A method of fabricating a maritime platform assembly comprising the steps of stabilizing a foundation raft on a support alongside a fixed quay, translationally moving at least substantially the whole of an erect tower structure from land adjacent the quay onto the foundation raft, securing the tower structure to the foundation raft, and then floating the assembly so formed off and away from the support, in which method the tower structure was previously made by the steps of constructing two side frame elements on the ground with their bases occupying their respective places on the planform of the completed tower, and then raising the side frame elements to a generally vertical position by pivotal action about their respective bases, and joining adjacent edges of the side frame elements.

2. a method as claimed in claim 1 in which the two side frame elements are in the form of three dimensional lattice frameworks which, when raised, substantially fill the space between them in their erect position.

3. A method of fabricating a maritime platform assembly adapted to be founded on the sea bed comprising the steps of stabilizing a sinkable foundation raft so that part of its undersurface rests on a support alongside a fixed quay, translationally moving at least substantially the whole of an erect tower structure, comprising a wave penetratable three dimensional frame work surmounted by an integral support for a deck, from land adjacent the quay to the foundation raft, permanently securing the tower structure to the foundation raft, and then floating the assembly so formed off and away from the support for founding on the sea bed in which method the tower structure is supported on rotation saddles used to locate a tubular base member on the tower planform, the saddles are disposed over sledge positions for sledges arranged to slide down a skidway extending from the land adjacent the quay onto the foundation raft, the tower structure is lowered from the saddles onto the sledges, the tower structure is slid onto the foundation raft and the skidway portions on the foundation raft are removed.

4. A method as claimed in claim 3 in which the skidways on the foundation raft overlie intermediate walls in the foundation raft structure.

5. A method of fabricating a maritime platform assembly adapted to be founded on the sea bed comprising the steps of stabilizing a sinkable foundation raft so that part of its undersurface rests on a support alongside a fixed quay, translationally moving at least substantially the whole of an erect tower structure, comprising a wave penetratable three dimensional frame work surmounted by an integral support for a deck, from land adjacent the quay to the foundation raft, permanently securing the tower structure to the foundation raft, and then floating the assembly so formed off and away from the support for founding on the sea bed in which method the tower structure was made by the steps of constructing two side frame elements on the ground with their bases occupying their respective places on the planform of the completed tower, and then raising the side frame elements to a generally vertical position by pivotal action about their respective bases, and joining adjacent edges of the side frame elements.

* * * * *